US009568022B2

(12) United States Patent
Chiou

(10) Patent No.: US 9,568,022 B2
(45) Date of Patent: Feb. 14, 2017

(54) IMPELLER AND FAN USING THE SAME

(71) Applicant: ASUSTeK COMPUTER INC., Taipei (TW)

(72) Inventor: Ing-Jer Chiou, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 408 days.

(21) Appl. No.: 14/218,955

(22) Filed: Mar. 18, 2014

(65) Prior Publication Data

US 2014/0286752 A1 Sep. 25, 2014

(30) Foreign Application Priority Data

Mar. 25, 2013 (CN) ..... 201310095991

(51) Int. Cl.
*F04D 29/66* (2006.01)
*F04D 17/16* (2006.01)
*F04D 25/06* (2006.01)

(52) U.S. Cl.
CPC ..... *F04D 29/666* (2013.01); *F04D 17/16* (2013.01); *F04D 25/0613* (2013.01)

(58) Field of Classification Search
CPC ..... F04D 29/666; F04D 29/24; F04D 29/242; F04D 29/28; F04D 29/281; F04D 29/282; F04D 29/30; F04D 17/16
USPC ..... 416/203
See application file for complete search history.

(56) References Cited

U.S. PATENT DOCUMENTS 6,340,291 B1 * 1/2002 Reckert ..... F04D 29/30 416/185
6,719,530 B2 4/2004 Chow
2003/0123975 A1 * 7/2003 Horng ..... F04D 29/666 415/119
2008/0247868 A1 * 10/2008 Lan ..... F04D 29/326 415/182.1
2010/0059210 A1 * 3/2010 Li ..... F04D 29/38 165/121

FOREIGN PATENT DOCUMENTS

CN 101285484 A 10/2008
CN 102518602 A 6/2012
CN 103775378 A 5/2014

* cited by examiner

*Primary Examiner* — Craig Kim
*Assistant Examiner* — Michael Sehn
(74) *Attorney, Agent, or Firm* — CKC & Partners Co., Ltd.

(57) ABSTRACT

An impeller which is applied to a fan includes a hub, a plurality of first centrifugal blade and a plurality of second centrifugal blades. The hub is disposed in an accommodating space of the fan. The first centrifugal blades and the second centrifugal blades are connected to the hub. The first centrifugal blades have first ends away from the hub. The second centrifugal blades have second ends away from the hub. A distance between the second end and a center of the hub is larger than that between the first end and the hub center, and the first centrifugal blades and the second centrifugal blades are arranged periodically. Thus, an airflow noise in a constant frequency generated by the impeller can be avoided, and noises in inconstant frequency would not accumulate or generate annoying noise peak.

8 Claims, 7 Drawing Sheets

IMPELLER AND FAN USING THE SAME

RELATED APPLICATIONS

This application claims priority to China Application Serial Number 201310095991.1, filed Mar. 25, 2013, the entirety of which is herein incorporated by reference.

BACKGROUND OF THE INVENTION

Field of the Invention

The invention relates to an impeller and a fan and, more particularly, to an impeller whose centrifugal blades are arranged periodically and a fan using the same.

Description of the Related Art

Electronic devices generate heat while operating, and if the heat is not dissipated efficiently, the electronic devices may easily crash, or electronic elements of the electronic device may be damaged, which results in property loss and may hurt the user. Therefore, a fan is usually disposed in the electronic device to solve the overheating problem. The fan blows wind to bring the heat generated, by the electronic device away via forced convection.

Since performance of an electronic chip is improved with more heat generated, the temperature in the electronic device grows higher, and thus the rotating speed of a motor in the fan increases continually. Though air velocity of the fan can be increased by improving the rotating speed of the motor, the fan with the high rotating, speed generates more noise, which annoys users.

The conventional fan includes an impeller and a casing. The impeller includes a plurality of blades, and the casing includes a tongue for increasing pressure. When the blades of the impeller pass the tongue, airflow noise in a constant frequency is generated due to the length of each of the blades being the same and a distance between each blades and the tongue being constant. Continuous noise in a constant frequency can accumulate and generate noise peak, which discomforts the user.

BRIEF SUMMARY OF THE INVENTION

An impeller and a fan using the same are provided.

The impeller includes a hub, a plurality of first centrifugal blades and a plurality of second centrifugal blades. The hub is disposed in accommodating space. The first centrifugal blades are connected to the hub, and each of the first centrifugal blades has a first end away from the hub. The second centrifugal blades are connected to the hub, and each of the second centrifugal blades has a second end away from the hub. A distance between the second end and a center of the hub is larger than a distance between the first end and the center of the hub, and the first centrifugal blades and the second centrifugal blades are arranged periodically.

A fan is also provided. The fan includes an impeller and a driving device, and the driving device drives the impeller to rotate.

As stated above, the distance between the second end of the second centrifugal blades and a center of the hub is larger than that between the first end of the first centrifugal blades and the center of the hub, and the distance between the first end and the tongue of the casing is larger than that between the second end and the tongue; therefore, the distance between the blades and the tongue of the casing is not constant. Thus, when the impeller is disposed in the casing of the fan, an airflow noise in a constant frequency generated by the impeller can be avoided, and noises in inconstant frequency would not accumulate or generate annoying noise peak.

Furthermore, since the first centrifugal blades and the second centrifugal blades are arranged periodically, the impeller can keep balance in rotating and does not incline due to the different lengths of the first centrifugal blades and the second centrifugal blades.

These and other features, aspects and advantages of the present invention will become better understood with regard to the following description, appended claims, and accompanying drawings.

DETAILED DESCRIPTION OF THE EMBODIMENTS

Figure 1:
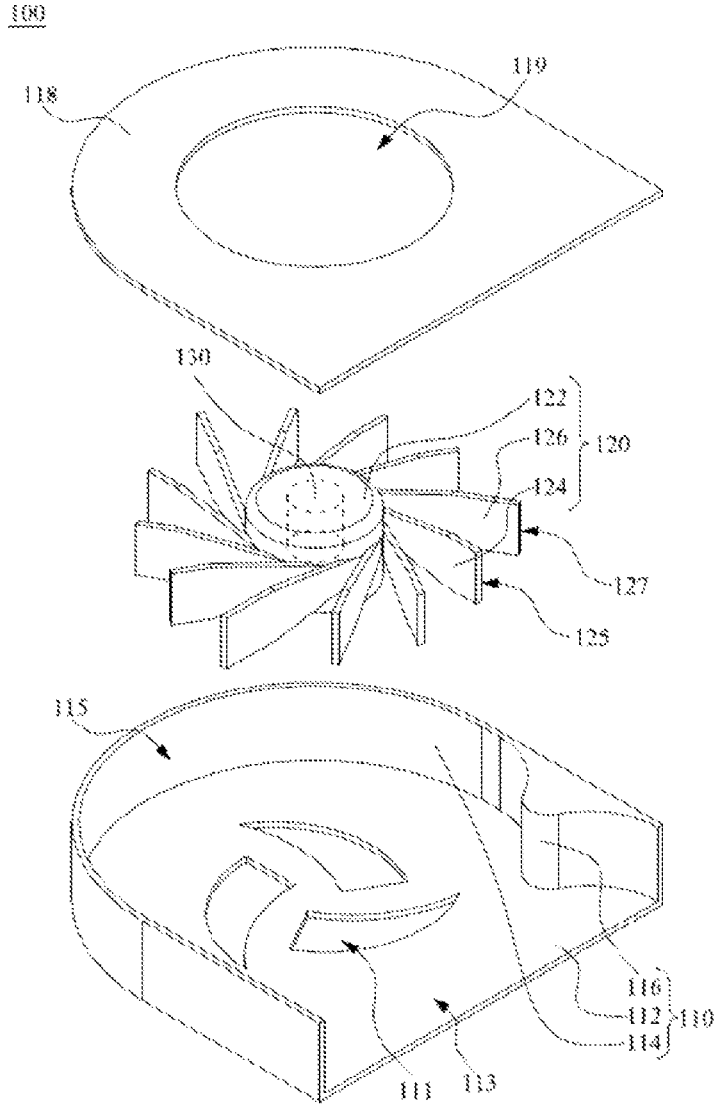
FIG. 1 is an exploded diagram showing a fan in a first embodiment.
Figure 2:
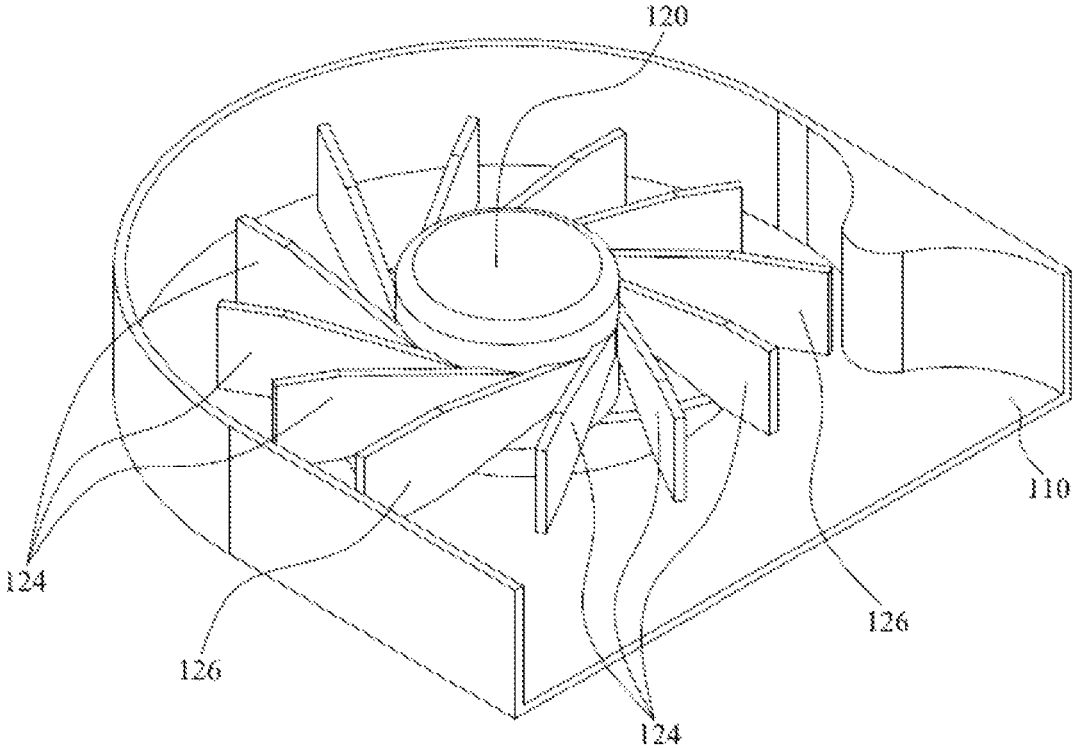
FIG. 2 is a schematic diagram showing an assembly of an impeller and a casing in FIG. 1.

FIG. 1 is an exploded diagram showing a fan 100 in a first embodiment. FIG. 2 is a schematic diagram showing an assembly of an impeller 120 and a casing 110 in FIG. 1. Please refer to FIG. 1 and FIG. 2, a fan 100 includes a casing 110, a driving device 130 and an impeller 120. The casing 110 includes accommodating space 115, a tongue 116 (which is also called a throat), inlets 111 and 119 along an axial direction and an outlet 113 alone a radial direction. The tongue 116 is adjacent to the outlet 113 and protrudes towards the accommodating space 115.

In the embodiment, the casing 110 includes a baseplate 112, a sidewall 114 and a cover 118. The sidewall 114 surrounds the baseplate 112 to form the accommodating space 115. The baseplate 112 has an inlet 111, the cover 118 has an inlet 119, and the sidewall 114 has an outlet 113. The tongue 116 is connected to the sidewall 114 and the baseplate 112, which is not limited herein.

The impeller 120 includes a hub 122, a plurality of first centrifugal blades 124 and a plurality of second centrifugal blades 126. The hub 122 is disposed in the accommodating space 115. The driving device 130 is connected to the hub 122 of the impeller 120. The driving device 130 may be a motor to drive the impeller 120 to rotate in the accommodating space 115, which is not limited herein.

The first centrifugal blades 124 are connected to the hub 122, and each of the first centrifugal blades 124 has a first end 125 away from the hub 122. The second centrifugal blades 126 are connected to the hub 122, and each of the second centrifugal blades 126 has a second end 127 away from the hub 122.

When the impeller 120 rotates in the accommodating space 115 and the blades pass the tongue 116, since a distance between the first ends 125 of the first centrifugal blades 124 and the tongue 116 is smaller than that between the first ends 125 and the sidewall 114, and the distance between the second ends 127 of the second centrifugal blades 126 and the tongue 116 is smaller than that between the second ends 127 and the sidewall 114, the tongue 116 can increase air pressure when the air passes the tongue 116.

In the embodiment, the casing 110 has two inlets 111 and 119, which means, the air can flows into the fan 100 through two sides of the fan, which is not limited herein.

Figure 3:
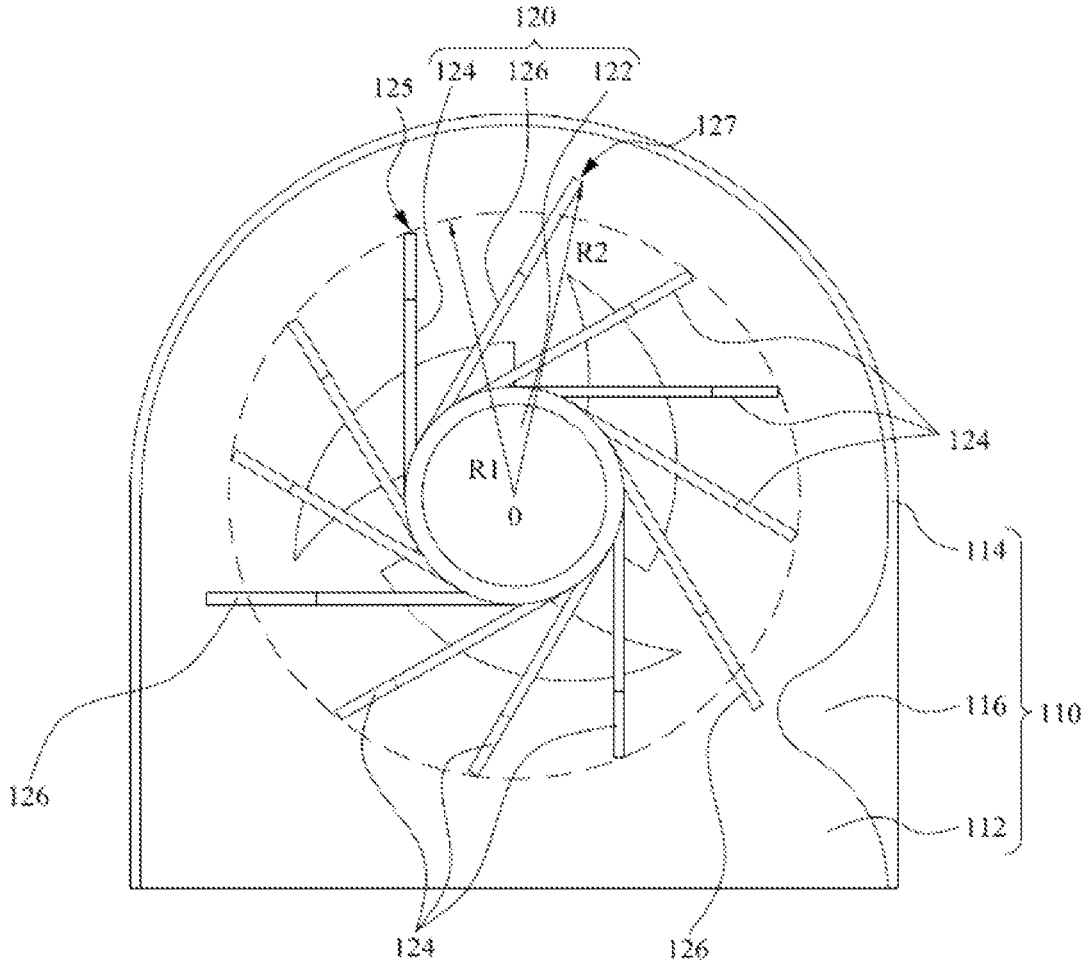
FIG. 3 is a top view showing the assembly of the impeller and the casing in FIG. 2.

FIG. 3 is a top view showing the assembly of the impeller 120 and the casing 110 in FIG. 2, in the embodiment, the impeller 120 includes nine first centrifugal blades 124 in a same length and three second centrifugal blades 126 in a same length, and every three first centrifugal blades 124 are adjacent to one second centrifugal blade 126, so the first centrifugal blades 124 and the second centrifugal blades 126 are arranged periodically. That is, twelve blades are arranged in three periods. Furthermore, the first centrifugal blades 124 are arranged symmetrically to the center O of the hub 122, and the second centrifugal blades 126 are also arranged symmetrically to the center O of the hub 122, which is not limited herein.

A distance R1 exists between the first ends 125 of the first centrifugal blades 124 and the center O of the hub 122, and a distance R2 exists between the second ends 127 of the second centrifugal blades 126 and the center O of the hub 122. The distance R2 is larger than the distance R1.

When the impeller 120 rotates and the blades pass the tongue 116, the first centrifugal blades 124 and the second centrifugal blades 126 pass the tongue 116 of the casing 110. Since the distance R2 is larger than the distance R1, the distance between the first ends 125 of the first centrifugal blades 124 and the tongue 116 is larger than the distance between the second ends 127 of the second centrifugal blades 126 and the tongue 116.

For example, the distance between the first ends 125 of the first centrifugal blades 124 and the tongue 116 may be 2 mm to 3 mm, and the distance between the second ends 127 of the second centrifugal blades 126 and the tongue 116 may be 1 mm to 2 mm, which is not limited herein.

Thus, the distance between the blades of the impeller 120 and the tongue 116 of the casing 110 is not constant. The inconstant distance can prevent the impeller 120 from generating the airflow noise in a constant frequency, and noises in inconstant frequency would not accumulate or generate annoying noise peak. Moreover, since the first centrifugal blades 124 and the second centrifugal blades 126 are arranged periodically and symmetrically, the impeller 120 can keep balance when the impeller 120 rotates and does not incline due to the difference between the length of the first centrifugal blades 124 and the length of the second centrifugal blades 126.

The length of the second centrifugal blades 126 is larger than that of the first centrifugal blades 124, and thus the distance R2 is larger than the distance R1, which does not need to greatly change the structure of the impeller 120 and the casing 110.

In the embodiment, the distances R1 between the first ends 125 of the first centrifugal blades 124 and the center O of the hub 122 are the same. The distances R between the second end 127 of the second centrifugal blades 126 and the center O of the hub 122 are the same. The distances between the second ends 127 of the second centrifugal blades 126 and the center O of the hub 122 may also be different.

Figure 4:
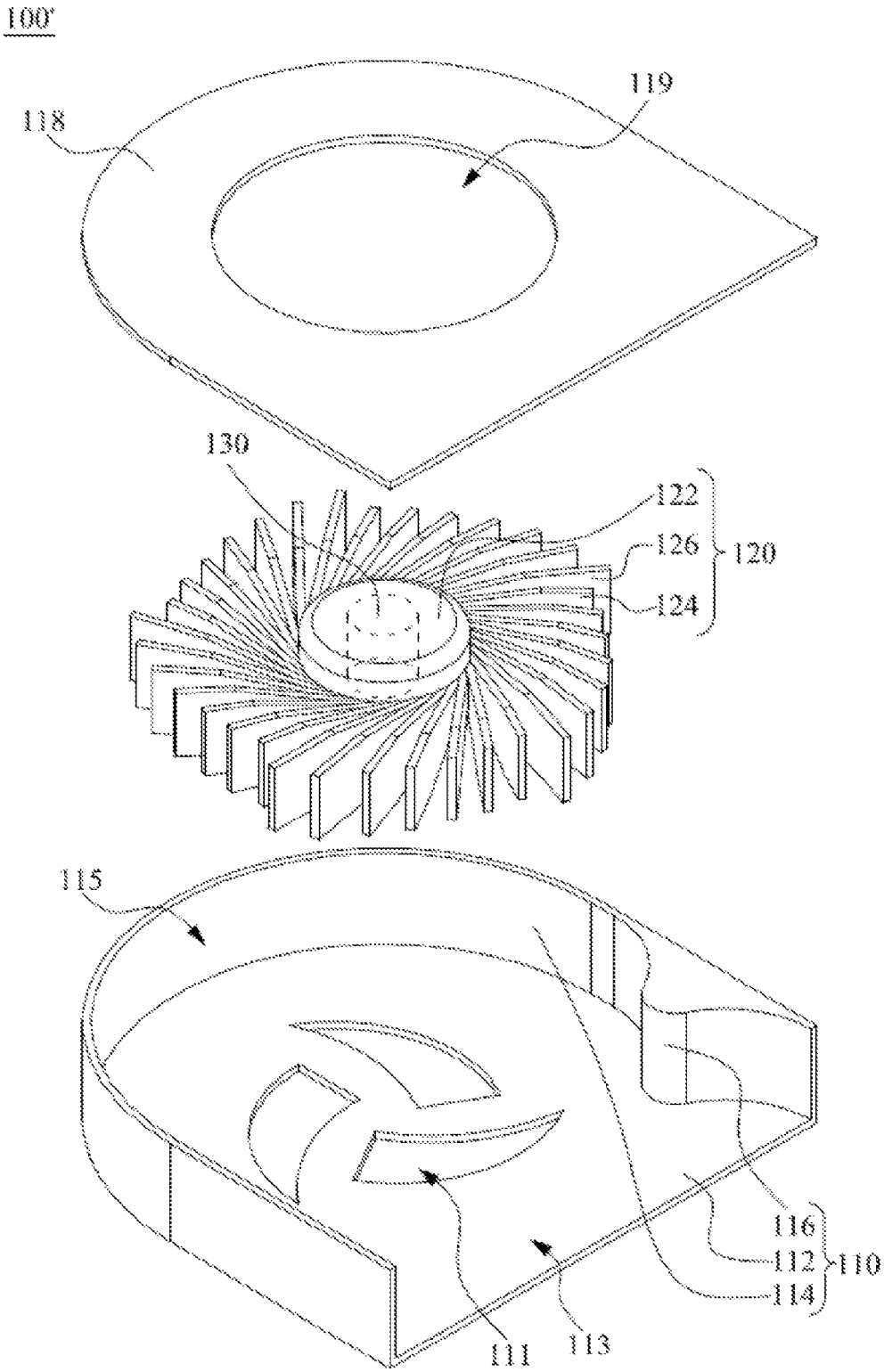
FIG. 4 is an exploded diagram showing a fan in a second embodiment.
Figure 5:
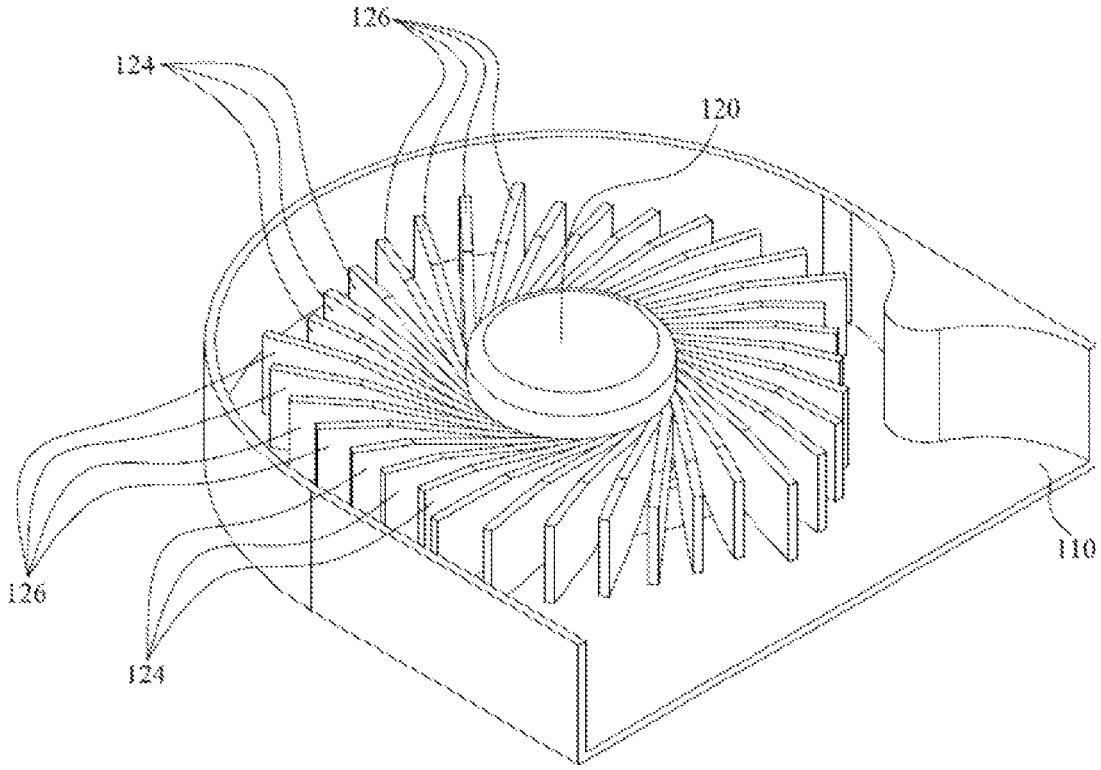
FIG. 5 is a schematic diagram showing an assembly of an impeller and a casing in FIG. 4.

FIG. 4 is an exploded diagram showing a fan 100' in a second embodiment. FIG. 5 is a schematics diagram showing an assembly of an impeller 120 and a casing 110 in FIG. 4. Please refer to FIG. 4 and FIG. 5, the fan 100' includes a casing 110, a driving device 130 and an impeller 120. The difference between the second embodiment and the first embodiment in FIG. 1 and FIG. 2 is that the impeller 120 includes more first centrifugal blades 124 and more second centrifugal blades 126, and the lengths of the second centrifugal blades 126 are different.

Figure 6:
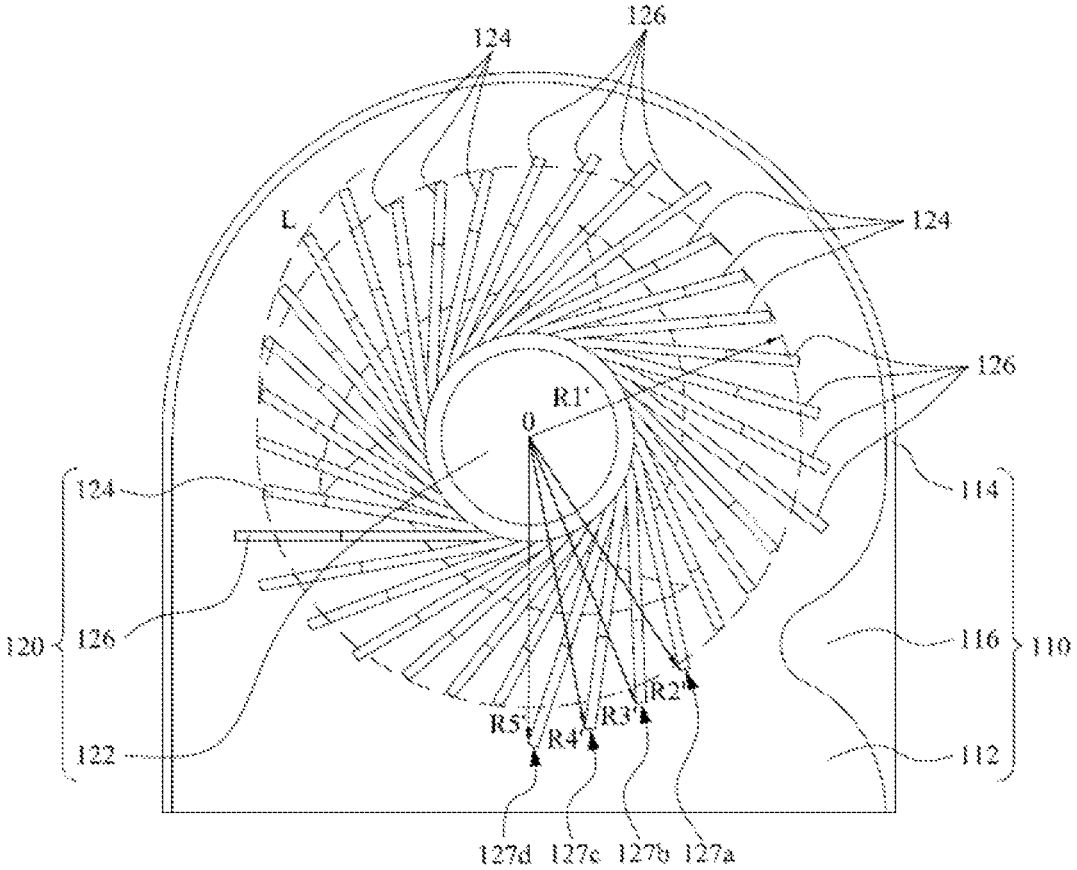
FIG. 6 is a top view showing the assembly of the impeller and the casing in FIG. 5.

FIG. 6 is a top view showing the assembly of the impeller 120 and the casing 110 in FIG. 5. In the embodiment, the impeller 120 includes fifteen first centrifugal blades 124 in a same length, and every three first centrifugal blades 124 are arranged as a group. The impeller 120 further includes twenty second centrifugal blades 126, and every four second centrifugal blades 126 are arranged as a group. Every three first centrifugal blades 124 are adjacent to four second centrifugal blades 126, so the first centrifugal blades 124 and the second centrifugal blades 126 are arranged periodically, which means, thirty five blades are arranged in five periods. Furthermore, the first centrifugal blades 124 and the second centrifugal blades 126 are arranged symmetrically to the center O of the hub 122, which is not limited herein.

A distance R1' exists between the first ends 125 of the first centrifugal blades 124 and the center O of the hub 122. Distances R2', R3', R4' and R5' exist between the second ends 127*a*, 127*b*, 127*c*, 127*d* of four adjacent second centrifugal blades 126 and the center O of the hub 122, respectively. The distances R2', R3', R4' and R5' are all larger than the distance R1'.

When the impeller 120 rotates, the first centrifugal blades 124 and the second centrifugal blades 126 pass the tongue 116 of the casing 110, and the distance between the first ends 125 of the first centrifugal blades 124 and the tongue 116 is larger than the distances between the second ends 127*a*, 127*b*, 127*c*, 127*d* of the second centrifugal blades 126 and the tongue 116.

For example, the distance between the first ends 125 of the first centrifugal blades 124 and the tongue 116 may be 2 mm to 3 mm, and the distances between the second ends 127*a*, 127*b*, 127*c*, 127*d* of the second centrifugal blades 126 and the tongue 116 may be 1 mm to 2 mm, which is not limited herein.

In the embodiment, the distances R2', R3', R4', R5' between the second ends 127*a*, 127*b*, 127*c*. 127*d* of the four adjacent second centrifugal blades 126 and the center O of the hub 122 increase gradually. That means, the distance R5' is larger than the distance R4', the distance R4' is larger than the distance R3', and the distance R3' is larger than the distance R2'. Thus, a ligature L of the second ends 127*a*, 127*b*, 127*c* and 127*d* of the second centrifugal blades 126 is an asymptote. Furthermore, the distance between the first ends 125 of the first centrifugal blades 124 and the center O of the hub 122 may also increase gradually.

The distance between the blades of the impeller 120 and the tongue 116 of the casing 110 is not constant, which prevents the impeller 120 from generating the airflow noise in a constant frequency and annoying noise peak. Moreover, since the first centrifugal blades 124 and the second centrifugal blades 126 are arranged periodically and symmetrically, the impeller 120 can keep balance in rotating.

Figure 7:
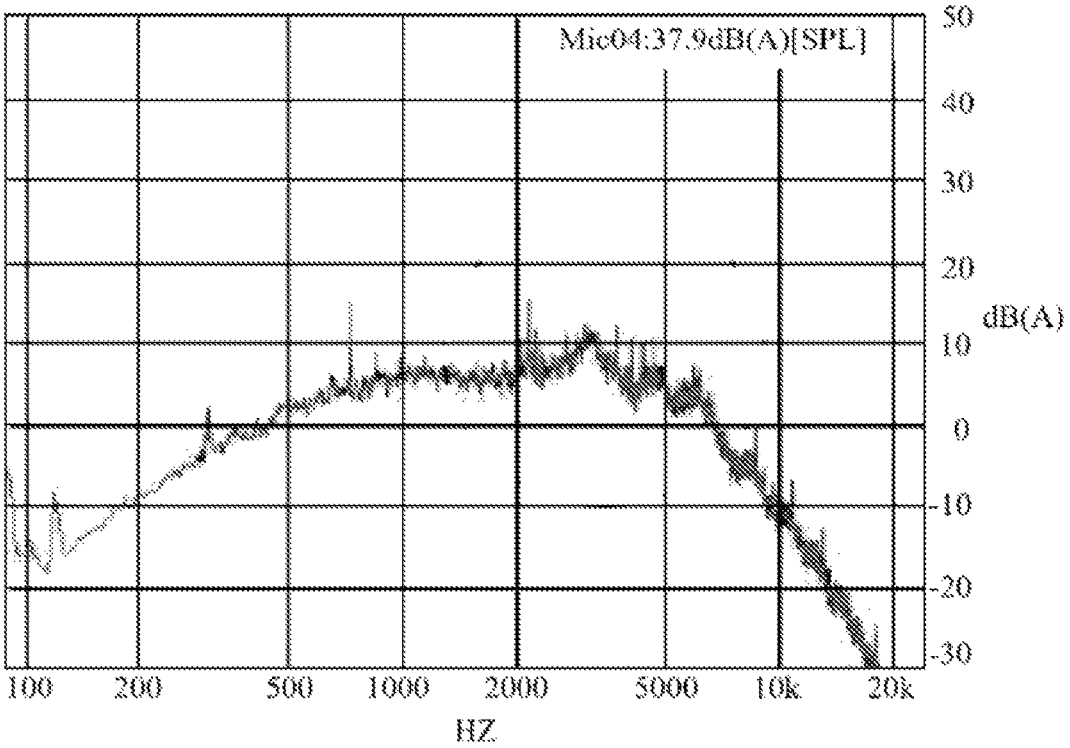
FIG. 7 is a diagram showing a frequency of noise when the impeller in FIG. 6 rotates.

FIG. 7 is a diagram showing a frequency of noise when the impeller 120 in FIG. 6 rotates. The horizontal axis indicates a frequency of sound and the vertical axis indicates a volume of sound. Please refer to FIG. 6 and FIG. 7, when the impeller 120 rotates, the first centrifugal blades 124 and the second centrifugal blades 126 pass the tongue 116 of the casing 110 and generate a noise in blade pass frequency (BPF).

In the embodiment, the noise peak of the impeller 120 is below 15 db (A), and the occurring frequency of the noise peak is low. The noise peak of the conventional impeller with blades in same length is above 20 db (A), and the noise peak occurs more frequently.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. An impeller applied to a fan, wherein the fan includes an accommodating space, the impeller comprising:

a hub disposed in the accommodating space;

a plurality of first centrifugal blades connected to the hub, each of the first centrifugal blades has a first end away from the hub; and a plurality of second centrifugal blades connected to the hub, each of the second centrifugal blades has a second end away from the hub, wherein at least two of the second centrifugal blades are adjacent, and the two adjacent second centrifugal blades are located between two of the first centrifugal blades;

wherein a distance between the second end and a center of the hub is larger than a distance between the first end and the center of the hub, and the first centrifugal blades and the second centrifugal blades are arranged periodically; wherein a distance between the center of the hub and the second end of the two adjacent centrifugal blades is greater than a distance between the center of the hub and the second end of the other one of the two adjacent second centrifugal blades.

2. The impeller according to claim 1, wherein the first centrifugal blades are arranged symmetrically to the center of the hub.

3. The impeller according to claim 1, wherein the second centrifugal blades are arranged symmetrically to the center of the huh.

4. The impeller according to claim 1, wherein distances between the first ends of the first centrifugal blades and the center of the hub are the same.

5. The impeller according to claim 1, wherein distances between the second ends of the second centrifugal blades and the center of the hub increase gradually.

6. The impeller according to claim 1, wherein distances between the first ends of the first centrifugal blades and the center of the hub increase gradually.

7. The impeller according to claim 5, wherein a ligature of the second ends of the second centrifugal blades is an asymptote.

8. A fan, comprising:

an accommodating space;

an impeller, the impeller comprising:

a hub disposed in the accommodating space;

a plurality of first centrifugal blades connected to the hub, each of the first centrifugal blades has a first end away from the hub; and a plurality of second centrifugal blades connected to the hub, each of the second centrifugal blades has a second cud away from the hub, wherein at least two of the second centrifugal blades are adjacent, and the two adjacent second centrifugal blades are located between two of the first centrifugal blades; wherein a distance between the second end and a center of the hub is larger than a distance between the first end and the center of the hub, and the first centrifugal blades and the second centrifugal blades are arranged periodically; wherein a distance between the center of the hub and the second end of the two adjacent centrifugal blades is greater than a distance between the center of the hub and the second end of the other one of the two adjacent second centrifugal blades; and a motor driving the impeller to rotate.

* * * * *